US006029547A

United States Patent [19]

Eggert et al.

[11] Patent Number: 6,029,547

[45] Date of Patent: Feb. 29, 2000

[54] COMPOSITE SOCKET WITH DUAL INSERTS AND ANNULAR REINFORCING MEMBER

[75] Inventors: Daniel M. Eggert, Kenosha; Marco E. DeVecchis, Racine, both of Wis.; Michael Q. Thompson, Waukegan, Ill.; Stacy T. Spracklin, Kenosha, Wis.; William T. Pagac, Kenosha, Wis.; Robert C. Gibson, Racine, Wis.

[73] Assignee: Snap-ons Tools Company, Kenosha, Wis.

[21] Appl. No.: 09/005,680

[22] Filed: Jan. 12, 1998

[51] Int. Cl.[7] ..... B25B 13/00

[52] U.S. Cl. ..... 81/124.6; 81/124.5; 81/125

[58] Field of Search ..... 81/125, 124.5, 81/124.6

[56] References Cited

U.S. PATENT DOCUMENTS

| | | |
|---|---|---|
| 1,458,894 | 6/1923 | Schwarz . |
| 1,488,217 | 3/1924 | Prestek . |
| 2,457,451 | 12/1948 | Domack . |
| 3,012,325 | 12/1961 | Elam . |
| 3,312,260 | 4/1967 | MacNeill . |
| 3,704,602 | 12/1972 | Einhorn . |
| 3,779,105 | 12/1973 | Triplett et al. . |
| 5,101,695 | 4/1992 | Johnson . |
| 5,139,460 | 8/1992 | Hoyt, III et al. . |
| 5,184,529 | 2/1993 | Matsubara et al. . |
| 5,487,432 | 1/1996 | Thompson . |

FOREIGN PATENT DOCUMENTS

| | | |
|---|---|---|
| 458771 | 11/1991 | European Pat. Off. . |
| 565919 | 10/1993 | European Pat. Off. . |
| 2240083 | 7/1975 | France . |
| 9202275 | 6/1995 | Germany . |
| 620970 | 4/1949 | United Kingdom . |

*Primary Examiner*—Timothy V. Eley
*Assistant Examiner*—Willie Berry, Jr.
*Attorney, Agent, or Firm*—Emrich & Dithmar

[57] ABSTRACT

A socket tool has an elongated body with driving and driven inserts, respectively, embedded in the opposite ends thereof, the inserts being flush with or recessed inwardly from the ends of the body. The inserts may be knurled around all or a portion of the outer surfaces thereof. Metal or non-metallic annular reinforcing members encircle at least one of the inserts. In one embodiment the reinforcement is a non-metallic sleeve which encircles the body along its entire length, and which may have end flanges overlapping the ends of the body. In other embodiments the reinforcement is entirely embedded in the body and in contact with the inner end surface and/or the peripheral side surface of at least one insert. In one embodiment the reinforcement extends from the insert to the outer surface of the body.

18 Claims, 2 Drawing Sheets

COMPOSITE SOCKET WITH DUAL INSERTS AND ANNULAR REINFORCING MEMBER

BACKGROUND OF THE INVENTION

1. Field of the Invention

The invention relates generally to socket tools of the type used for socket wrenches and the like and, more particularly, to socket tools of the type which are designed for used in environments which are corrosive or present a spark or shock hazard.

2. Description of the Prior Art

Socket tools are typically formed of a suitable metal, such as steel, for strength and toughness. However, it is known to provide socket tools formed of a non-metallic material, such as a suitable plastic material, for use in applications which might present a corrosive environment or an electrical spark or shock hazard. It is also known to provide a metal insert in such a non-metallic socket tool for engagement with the associated driven member to improve the strength and/or wear resistance of the tool. In this regard, the present invention is an improvement of the composite socket tools disclosed in commonly owned copending U.S. application Ser. No. 698,782, filed Aug. 16, 1996 and entitled "Composite Socket with Double Inserts." That application discloses a socket tool body formed of a glass-fiber reinforced nylon material with insert molded metal inserts in both the driving and driven ends thereof. The inserts have knurls or serrations on their outer surfaces to inhibit rotation relative to the tool body.

In has been found that, under very high torque loads, such insert-molded socket tools may tend to fail by fragmenting apart. It is believed that this occurs by reason of fracture lines propagating along knurls on the outer surface of the insert and causing portions of the surrounding plastic material to break away.

SUMMARY OF THE INVENTION

It is a general object of the invention to provide an improved socket tool with a body having insert elements therein, which avoids the disadvantages of prior such tools, while affording additional structural and operating advantages.

An important feature of the invention is the provision of a socket tool of the type set forth which inhibits fragmentation of the tool under high torque loads.

In connection with the foregoing feature, a further feature of the invention is the provision of a socket tool of type set forth, which provides encapsulation for the tool.

Still another feature of the invention is the provision of a socket tool of the type set forth, which inhibits propagation of fracture lines under high torque loads.

Still another feature of the invention is the provision of a socket tool of the type set forth, which is of simple and economical construction.

Yet another feature of the invention is the provision of a method for forming a socket tool of the type set forth.

Certain ones of these and other features of the invention may be attained by providing a socket tool for use with associated driving and driven elements, the tool comprising: an elongated body having an exterior surface and having a driven end and a driving end, an insert disposed in an end of the body and defining an opening for releasably mateably receiving one of the associated driven and driving elements, and a non-metallic annular reinforcing member carried by the body and encircling the insert.

Other features of the invention may be attained by providing a socket tool of the type described wherein the reinforcing member is completely embedded in the body.

Still further features of the invention are attained by providing a method of molding a socket tool in a mold apparatus defining a mold cavity, the method comprising the steps of: disposing an insert in the mold cavity, disposing an annular reinforcing member in the mold cavity encircling at the insert, and introducing into the mold cavity a charge of mold material and causing the charge to flow around the insert and into contact with the reinforcing member to form a socket tool, whereby the insert is embedded in the mold material.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
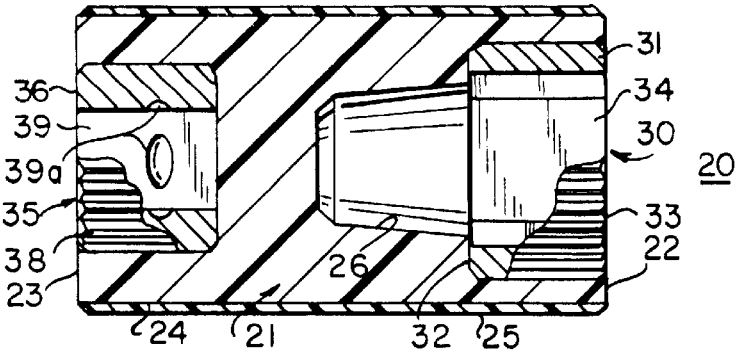
FIG. 1 is a view in vertical section, with portions shown in elevation, of a socket tool in accordance with a first embodiment of the present invention.

Referring to FIG. 1, there is illustrated a socket tool, generally designated by the numeral 20, constructed in accordance with and embodying the features of a first embodiment of the present invention. The socket tool 20 has an elongated, cylindrical body 21, preferably formed of a composite, moldable material, such as a high-strength, glass fiber-reinforced molding compound, which could be either an injection molding compound or a sheet molding compound for compression molding. The body 21 has substantially parallel circular end faces 22 and 23 joined by a cylindrical outer surface 24. The body 21 has formed in one end thereof an axial clearance cavity 26 with a generally frustoconical inner end portion. A reinforcing sleeve 25 surrounds the outer cylindrical surface 24 along its entire length, the sleeve 25 being formed of a suitable high-strength, non-metallic molding material, such as a super-tough nylon material.

Insert molded in one end of the body 21 is a driving insert 30, preferably formed of a suitable metal, which is generally annular in shape and is coaxial with the body 21, having an outer end surface 31 substantially flush with the end face 22 of the body 21, and an inner end surfaces 32 spaced axially inwardly from the end face 22. The insert 30 has a generally cylindrical outer surface which is preferably provided around its entire circumference with a straight knurl 33 extending longitudinally of the body 21, to enhance gripping contact with the surrounding composite material of the body 21 to inhibit relative rotation of the parts. The insert 30 defines an opening 34 therethrough which is of a polygonal shape, typically hexagonal, adapted for mating engagement with an associated member to be driven, such as a nut, bolt, or the like. The opening 34 communicates with the cavity 26, the latter providing clearance for a bolt or stud onto which a nut may be driven by the socket tool 20, in a known manner.

Embedded in the opposite end of the body 21 is a driven insert 35, also preferably formed of a suitable metal, which has an outer end surface 36 substantially flush with the end face 23 of the body 21 and an inner end surface 37 spaced axially inwardly from the end face 23. Preferably, the outer, generally cylindrical surface of the insert 35 is provided with a straight knurl around the entire circumference thereof to inhibit relative rotational movement of the parts. The insert 35 preferably defines a square opening 39 therethrough for receiving an associated driving member, such as a square drive lug of an associated driving tool. The faces of the square opening 39 may be provided with ball recesses 39*a* for receiving a detent ball of the associated drive lug, in a known manner.

The socket tool 20 is preferably formed by insert molding, with the inserts 30 and 35 and the reinforcing sleeve 25 being positioned in a mold apparatus by suitable fixturing so that the composite material mold charge can flow between the reinforcing sleeve 25 and the inserts 30 and 35 to form the composite body 21.

In operation, when the socket tool 20 is subjected to very high torque loads, it can tend to fail by the formation of fracture lines which may tend to propagate along the knurls 33 and/or 38 of the inserts 30 and 35, eventually causing portions of the body 21 to fragment. The presence of the reinforcing sleeve 25 prevents any such fragmented portions from breaking off and separating from the socket tool 20.

Figure 2:
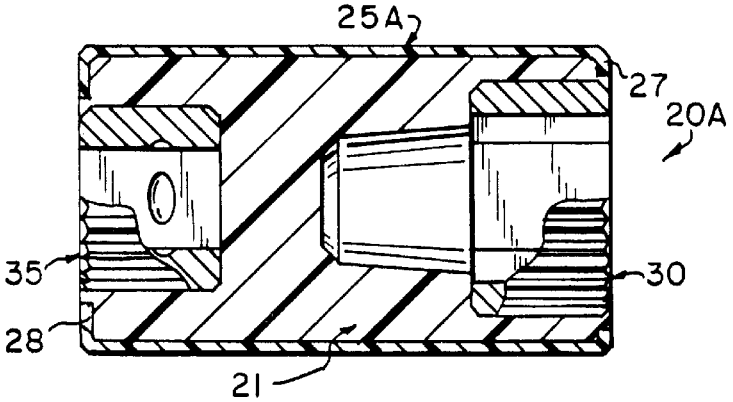
FIG. 2 is a view similar to FIG. 1 of a second embodiment of the invention.

Referring to FIG. 2, there is illustrated another embodiment of socket tool, generally designated by the numeral 20A, which is substantially identical to the socket tool 20 of FIG. 1, with the exception of the reinforcing sleeve. More particularly, the tool 20A has a reinforcing sleeve 25A which is similar to the reinforcing sleeve 25, except that it is provided at the opposite ends thereof, respectively, with radially inwardly extending annular end flanges 27 and 28 which are, respectively, embedded in the adjacent end faces 22 and 23 of the body 21. The socket tool 20A is formed and functions in substantially the same manner as was described above in connection with the socket tool 20, except that the end flanges 27 and 28 provide additional protection against portions of the body 21 breaking off and separating axially from the socket tool 20A.

Figure 3:
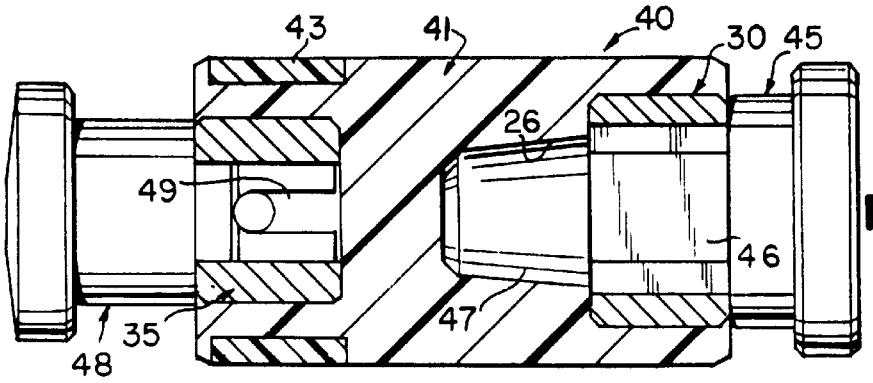
FIG. 3 is a view similar to FIG. 1 of another embodiment of the invention, and illustrating insert holders used during the molding of the tool.

Referring to FIG. 3, there is illustrated a socket tool in accordance with another embodiment of the invention, designated by the number 40, having an elongated cylindrical body 41 which is substantially identical to the body 21 of FIG. 1, except that the socket tool 40 is provided with an annular reinforcing band 43 embedded in the outer cylindrical surface of the body 41 in encircling relationship with the driven insert 35. The reinforcing band 43 is preferably formed of a non-metallic material which may be the same material as that of the reinforcing sleeve 25 of FIG. 1, and is embedded in the body 41 so that the outer cylindrical surfaces of the body 41 and the reinforcing band 43 are flush with each other. While a single reinforcing band 43 is illustrated, it will be appreciated that a similar band could be provided in encircling relationship with the driving insert 30. Alternatively, a single reinforcing band could have an axial extent sufficient to encircle both of the inserts 30 and 35.

Also illustrated in FIG. 3 is an insert holder 45 for holding the driving insert 30 in the mold. The holder 45 has a hexagonal portion 46 over which the insert 30 is fitted, and a frustoconical inner end portion 47, which forms the inner end of the cavity 26 during the molding operation. Similarly, there is illustrated an insert holder 48 which has a square end portion 49 onto which the driven insert 35 is fitted. It will be appreciated that, during the molding of the socket tool 40, the holders 45 and 48 position the inserts 30 and 35 in appropriate coaxial locations in the mold, while the mold cavity itself (not shown) holds the reinforcing band 43. A charge of composite molding material is then flowed around the inserts 30 and 35 and the insert holder end portion 47, and inside the reinforcing band 43 to form the body 41. FIG. 3 illustrates the assembly after it has been removed from the mold, but before removal of the insert holders 45 and 48. It will be appreciated that similar insert holders are utilized during the formation of the socket tools 20 and 20A of FIGS. 1 and 2.

In operation, in the event that the socket tool 40 fails under very high torque loads by propagation of fault or crack lines along the external knurls of the insert 35, the reinforcing band 43 will serve to prevent fragmented portions of the body 41 from separating in a radial direction.

Figure 4:
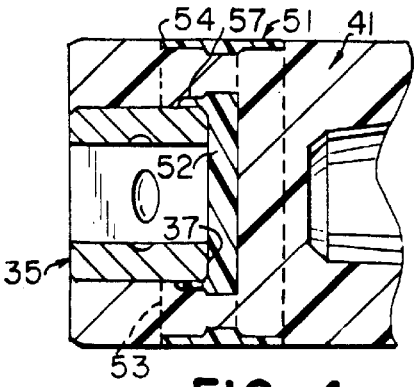
FIG. 4 is a fragmentary view in vertical section of a socket tool in accordance with yet another embodiment of the invention.
Figure 5:
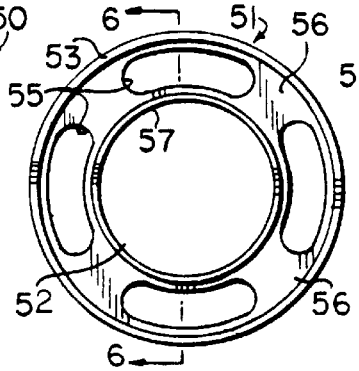
FIG. 5 is a plan view of the retaining member of the socket tool of FIG. 4.
Figure 6:
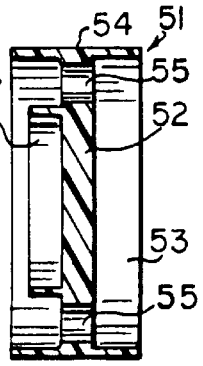
FIG. 6 is a view in vertical section taken along the line 6—6 in FIG. 5.

Referring now to FIGS. 4–6, there is illustrated another socket tool, generally designated by the numeral 50, in accordance with another embodiment of the invention. The socket tool 50 is substantially identical to the socket tool 40 of FIG. 3, except that the reinforcing band 43 is replaced with a reinforcing member 51, which has a central circular disk portion 52 which, in use, is fitted against the inner end surface 37 of the driven insert 35. Integral with the central disk portion 52 around its entire periphery is a cylindrical flange 53, which extends substantially equal distances outwardly from the opposite sides of the disk 52 coaxially therewith. The parts are so dimensioned that, in use, the outer diameter of the cylindrical flange 53 is substantially the same as that of the body 41 of the tool 50 so that the outer surface 54 of the flange 53 is exposed. Formed through the central disk 52 just inside the cylindrical flange 53 are a plurality of equiangularly spaced-apart, elongated, arcuate apertures 55, such that the remaining unapertured portions 56 of the central disk portion 52 function as spokes of a wheel. Integral with the central disk 52 and projecting axially therefrom is a cylindrical wall 57 which is disposed radially just inside the apertures 55 and is dimensioned to fit around the outer cylindrical surface of the driven insert 35, as can be seen in FIG. 4.

The socket tool 50 is formed in substantially the same manner as was described above in connection with the socket tool 40 of FIG. 3, except that it will be appreciated that, during the molding operation, the molding compound material will flow through the apertures 55 of the reinforcing member 51. Preferably, the reinforcing member 51 is formed of a suitable non-metallic material, which may be the same material as is used in the reinforcing band 43 of FIG. 3. In operation, the reinforcing member 51 serves not only to inhibit radial separation of fragmented parts of the body 41, but also serves to inhibit propagation of fracture or fault lines to the inner end of the driven insert 35. Thus, the reinforcing member 51 also serves to inhibit fragmentation of the body 41 at all.

Figure 7:
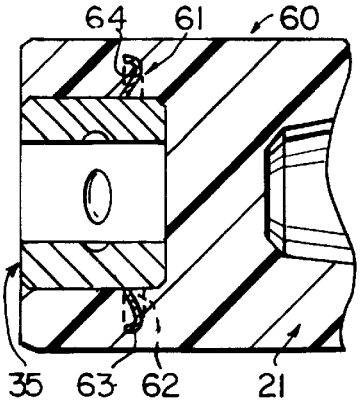
FIG. 7 is a view similar to FIG. 4 of another embodiment of the invention.

Referring to FIG. 7, there is illustrated another socket tool, generally designated by the numeral 60, in accordance with another embodiment of the invention. The socket tool 60 is substantially the same as the socket tool 40 of FIG. 3, except that the reinforcing band 43 is replaced with a reinforcing member 61, which may be in the form of a lock washer, or the like. More particularly, the reinforcing member 61, which may be formed either of metal or of a suitably tough non-metallic material, such as the same material used for the reinforcing band 43 of FIG. 3, has an annular body 62 with a curved radial outer end portion 63. Circumferentially spaced-apart portions of the body 62 are stamped therefrom and deflected out of the plane thereof to form flexible and resilient prongs 64, in a known manner.

In formation of the socket tool 60, the reinforcing member 61 is press fitted down around the driven insert 35 before the insert 35 is positioned in the mold. Then, during the molding operation, molding compound material will tend to flow through the apertures between the prongs 64 and the remainder of the annular body 62, as well as around the reinforcing member 61. Preferably, the reinforcing member 61 is so dimensioned that, in use, it is spaced from the outer peripheral surface of the body 21 so as to be completely embedded therewithin. In use, the reinforcing member 61 serves to inhibit fault or failure lines from propagating to the inner end of the insert 35, thereby inhibiting fragmenting of the body 21. While a reinforcing member 61 has been illustrated only in connection with the driven insert 35, it will be appreciated that a similar reinforcing member could be utilized in connection with the driving insert 30.

Figure 8:
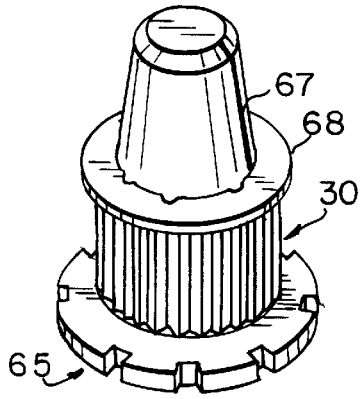
FIG. 8 is a perspective view of an insert holder holding a drive insert and associated reinforcing member for use in forming a cutting tool in accordance with another embodiment of the invention.
Figure 10:
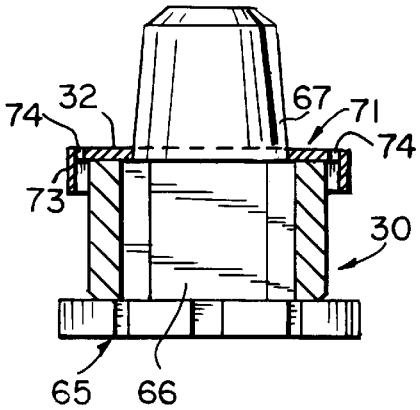
FIG. 10 is a side elevational view of the holder of FIG. 8, having mounted thereon the insert and reinforcing member of the socket tool of FIG. 9.

Referring to FIGS. 8 and 10, there is illustrated an insert holder 65, having a hexagonal portion 66 and a frustoconical portion 67. In FIG. 8, the holder 65 is illustrated in use holding a driving insert 30 in connection with another embodiment of reinforcing washer 68, which may be formed of metal or non-metallic material and may be provided with circumferentially spaced indentations on the inner periphery thereof. It will be appreciated that, in the finished socket tool, the washer 68 will be embedded firmly against the inner end of the insert 30.

Figure 9:
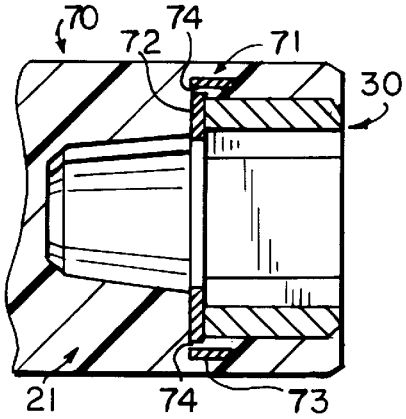
FIG. 9 is a fragmentary view in vertical section of a socket tool in accordance with another embodiment of the invention.

Referring to FIGS. 9 and 10, there is illustrated a socket tool 70 in accordance with another embodiment of the invention, which may be substantially the same as the socket tool 60, except that there is provided a reinforcing washer 71 in connection with the driving insert 30. The washer 71 has an annular body 72 integral at its outer peripheral edge with an axially extending cylindrical flange 73. A plurality of circumferentially spaced openings 74 are formed through the body 72 adjacent to the flange 73. The washer 71 may be formed of metal or a non-metallic material, such as that used to form the reinforcing band 43 of FIG. 3. The washer 71 is dimensioned to fit over the inner end surface 32 of the driving insert 30 with the openings 74 disposed outboard of the insert 30. Referring to FIG. 10, in formation of the socket tool 70, the insert 30 is fitted onto the hexagonal portion 66 of the holder 65 of FIG. 8, and then the washer 71 is fitted over the inner end of the insert 30 for positioning the parts in the mold. In use, the reinforcing washer 71 operates in substantially the same manner as the reinforcing member 51 of FIG. 4. While the reinforcing washers 68 and 71 are illustrated only in connection with the driving insert 30, it will be appreciated that similar washers could be utilized in connection with the driven insert 35.

Figure 11:
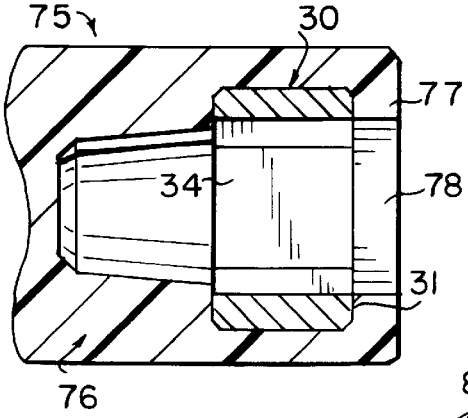
FIG. 11 is a view similar to FIG. 8 of a socket tool in accordance with another embodiment of the invention.

In FIG. 11, there is illustrated another socket tool 75 which is substantially similar to the socket tool 70 of FIG. 9, except that there is no reinforcing member 71. Instead, the body 76, which is basically the same as the body 21 of FIG. 9, has an annular lip portion 77 at the outer end thereof which overlaps the outer end surface 31 of the driving insert 30, so that the insert 30 is fully embedded in and recessed within the adjacent end of the body 76. The lip portion 77 defines a circular opening 78 which communicates with the inside of the insert 30 and preferably has a diameter substantially the same as the across-corners dimension of the hex opening 34 in the insert 30. It will be appreciated that, in formation of the socket tool 75, the insert 30 is positioned in the mold so that the charge of composite plastic material will flow around the end face 31 of the insert 30 to form the lip portion 77. In use, the socket tool 75 functions in substantially the same manner as the socket tool 40, except that the lip portion 77 provides further electrical insulation for the insert 30 and improves retention thereof in the socket tool 75.

Figure 12:
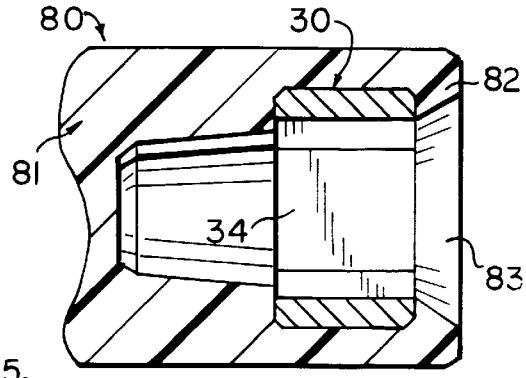
FIG. 12 is a view similar to FIG. 11 of yet another embodiment of the invention.

Referring to FIG. 12, there is illustrated a socket tool 80 which is substantially the same as the socket tool 75 of FIG. 11, having a body 81 provided with a lip portion 82, the only difference being that the access opening 83 defined by the lip portion 82 has a substantially frustoconical wall 83 to facilitate entry of the driven fastener into the hexagonal opening 34 of the insert 30.

Figure 13:
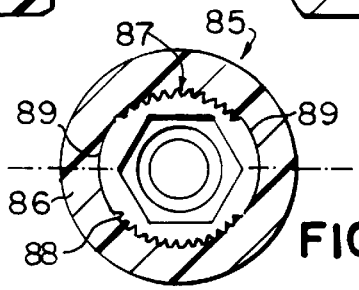
FIG. 13 is a reduced view in vertical section of a socket tool in accordance with another embodiment of the invention.

In FIG. 13 there is illustrated another socket tool 85, which may be of the same type as any of the previously described socket tools 20, 20A, 40, 50, 60, 70, 75 or 80, the tool having a composite body 86 with a hexagonal driving insert 87 which is substantially the same as the insert 30, except that the knurling extends only part way around the circumference of the insert 87. More specifically, knurling is provided at diametrically opposed regions 88, but is not provided along diametrically opposed regions 89, the regions 89 preferably being disposed at the location of the knit lines of the mold and opposite the parting plane to facilitate the molding operation. Each of the unknurled regions 89 preferably has an angular extent of at least 20°, centered opposite the parting plane. Otherwise, the socket tool 85 operates in substantially the same manner as the tools described above.

While only the driving inserts 30 are discussed in connection with the socket tool 75, 80 and 85, it will be appreciated that the same features may be applied to the opposite ends of those socket tools in connection with the driven insert 35. Thus, the driven inserts 35 may be recessed so that their outer end surfaces 36 are covered with lip portions corresponding to the lip portions 77 and 82, and the driven inserts 35 may be only partially knurled around the external surface thereof, like the insert 87.

From the foregoing, it can be seen that there has been provided an improved socket tool which is of simple and economical construction and provides an insulating body which, nevertheless, has substantial strength while, at the same time, inhibiting fragmenting-type failure under high-torque loads and preventing fragmenting-type separation of the tool under such failure conditions.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A socket tool for use with associated driving and driven elements, said tool comprising:

an elongated body having an exterior surface and having a driven end and a driving end, an insert disposed in an end of said body and defining an opening for releasably mateably receiving one of the associated driven and driving elements, and a non-metallic annular reinforcing member carried by said body and in contact with said insert along the perimeter of said insert.

2. The socket tool of claim 1, wherein said insert is a first insert, and further comprising a second insert disposed in another end of said body and defining an opening for releasably mateably receiving another of the associated driven and driving elements.

3. The socket tool of claim 2, wherein said reinforcing member encircles both of said inserts.

4. The socket tool of claim 1, wherein said body is formed of a glass fiber-reinforced nylon material.

5. The socket tool of claim 1, wherein said insert is formed of metal.

6. The socket tool of claim 1, wherein said reinforcing member has an annular exposed portion not covered by said body.

7. The socket tool of claim 6, wherein said reinforcing member includes a central hub portion in contact with said insert, and circumferentially spaced-apart spoke portions interconnecting said hub portion and said exposed portion.

8. A socket tool for use with associated driving and driven elements, said tool comprising:

an elongated body having an exterior surface and having a driven end and a driving end, an insert disposed in an end of said body and defining an opening for releasably mateably receiving a corresponding one of the associated drive and driving elements, and an annular reinforcing member completely embedded in said body and in contact with said insert along the perimeter of said insert.

9. The socket tool of claim 8, wherein said reinforcing member is formed of a non-metallic material.

10. The socket tool of claim 8, wherein said reinforcing member is formed of metal.

11. The socket tool of claim 8, wherein said reinforcing member is disposed closely adjacent to or in contact with said insert.

12. The socket tool of claim 8, wherein said insert is a first insert, and further comprising a second insert disposed in another end of said body and defining an opening for releasably mateably receiving another of the associated driven and driving elements, said reinforcing member encircling at least one of said inserts.

13. The socket tool of claim 8, wherein said at least one of said inserts has inner and outer annular end faces, said reinforcing member engaging said inner end face.

14. A socket tool for use with associated driving and driven elements, said tool comprising:

an elongated body having an exterior surface and having a driven end and a driving end, an insert disposed in an end of said body and defining an opening for releasably mateably receiving one of the associated driven and driving elements, and a non-metallic annular reinforcing member carried by said body and encircling said insert, said reinforcing member having an inner hub portion in contact with said insert and an outer cylindrical portion and a plurality of circumferentially spaced-apart spoke portions interconnecting said inner hub portion and said outer cylindrical portion.

15. A socket tool for use with associated driving and driven elements, said tool comprising:

an elongated body having a driven end and a driving end and having an exterior surface including spaced-apart end surfaces respectively at said ends and a length between said end surfaces, an insert disposed in an end of said body and defining an opening for releasably mateably receiving one of the associated driven and driving elements, and a non-metallic annular reinforcing member carried by said body externally thereof and encircling said insert, said reinforcing member extending the length of said body and having end flanges respectively overlapping said end surfaces of said body.

16. A socket tool for use with associated driving and driven elements, said tool comprising:

an elongated body having an exterior surface and having a driven end and a driving end, an insert disposed in an end of said body and defining an opening for releasably mateably receiving one of the associated driven and driving elements, said insert having a cylindrical outer surface which is knurled at first and second diametrically opposed locations therealong and is unknurled at third and fourth diametrically opposed locations thereon, and a non-metallic annular reinforcing member carried by said body and encircling said insert.

17. The socket tool of claim 16, wherein said insert is a first insert, and further comprising a second insert disposed in another end of said body and defining an opening for releasably mateably receiving another of the associated driven and driving elements.

18. The socket tool of claim 17, wherein said reinforcing member encircles both of said inserts.

* * * * *

UNITED STATES PATENT AND TRADEMARK OFFICE

CERTIFICATE OF CORRECTION

PATENT NO. : 6,029,547
APPLICATION NO. : 09/005680
DATED : February 29, 2000
INVENTOR(S) : Daniel M. Eggert et al.

It is certified that error appears in the above-identified patent and that said Letters Patent is hereby corrected as shown below:

Title Page, item (73)
Replace assignee "Snap-ons Tools Company" with --Snap-on Tools Company--.
Column 8, line 12, replace "claim 8," with --claim 12,--.

Signed and Sealed this

Thirty-first Day of July, 2007

JON W. DUDAS
*Director of the United States Patent and Trademark Office*